United States Patent [19]

Heiman

[11] Patent Number: 4,458,187

[45] Date of Patent: Jul. 3, 1984

[54] VENDING MACHINE CONTROL AND DIAGNOSTIC APPARATUS

[75] Inventor: Frederic P. Heiman, Los Gatos, Calif.

[73] Assignee: Mars, Inc., McLean, Va.

[21] Appl. No.: 512,580

[22] Filed: Jul. 12, 1983

Related U.S. Application Data

[63] Continuation of Ser. No. 250,385, Apr. 2, 1981, abandoned.

[51] Int. Cl.[3] ..... G07F 5/22

[52] U.S. Cl. ..... 318/490; 194/10; 221/21; 221/129

[58] Field of Search ..... 194/10, 9 R, 9 T, 2; 318/490, 21; 221/129, 127, 125; 324/173, 415; 340/515

[56] References Cited

U.S. PATENT DOCUMENTS

| | | | |
|---|---|---|---|
| 3,496,300 | 2/1970 | Stokes . | |
| 3,566,399 | 2/1977 | Weld . | |
| 3,687,255 | 8/1972 | Johnson | 194/10 |
| 3,691,431 | 9/1972 | Hendrickson et al. | 194/10 |
| 3,705,349 | 12/1972 | Arnold . | |
| 3,978,958 | 9/1976 | Zandstra | 194/10 |
| 4,044,877 | 8/1977 | Burton | 194/10 |
| 4,178,542 | 12/1979 | McCarthy . | |
| 4,220,235 | 9/1980 | Lindsey et al. | 194/10 |
| 4,225,056 | 9/1980 | Flubacker . | |
| 4,322,847 | 3/1982 | Dodge et al. . | |
| 4,354,616 | 10/1982 | Camp | 221/129 |

*Primary Examiner*—G. Z. Rubinson
*Assistant Examiner*—Arthur G. Evans
*Attorney, Agent, or Firm*—Davis, Hoxie, Faithfull & Hapgood

[57] ABSTRACT

Vending machine control and diagnostic apparatus for a vending apparatus having product delivery means comprising an electrically operated actuator for delivery of products, an impedance element and a circuit opening switch. The impedance element and the switch are connected electrically in series with each other and in a parallel circuit with the actuator, and the opening and closing of the switch is controlled by the operation of the actuator. The control and diagnostic apparatus detects changes in impedance of the parallel circuit.

18 Claims, 13 Drawing Figures

2100

VENDING MACHINE CONTROL AND DIAGNOSTIC APPARATUS

This application is a continuation of application Ser. No. 250,385, filed Apr. 2, 1981 now abandoned.

BACKGROUND OF THE INVENTION

1. Field of Invention

This invention relates to the control of vending machines, and particularly to the control of vending machines having a large number of actuators for vending a large quantity or a wide variety of products. The invention also relates to the diagnosis of operating defects in the vending machine, particularly defects in the actuators.

2. Description of the Prior Art

Most vending machines today employ brute force type selection circuits and blocker circuits to prevent more than one actuator from being actuated at a time. A typical blocker circuit comprises a group of single pole, double throw blocker switches each associated with one of the actuators and actuated by a cam which is rotated during that actuator's cycle. When all of the actuators are at their "home" or normal start-stop position, the switches are connected in series and supply a signal which enables a second set of switches, the selection switches. Typically, each selection switch is a single pole double throw switch associated with a single actuator. All of the selection switches are connected in series until one selection switch is actuated, causing it to interrupt the series connection of selection switches and apply current to the associated actuator. Once a selection is made and the selected actuator begins to move, its cam causes the associated blocker switch to move to its other position closing its hold contacts so that it supplies current to the selected actuator for the remainder of an actuator cycle. The interruption of the series connection of blocker switches through the blocker contacts disables the selection circuit so that no other actuators can be started until the originally selected actuator has completed its cycle.

It has been recognized for some time that the type of blocker circuit described above has a major disadvantage: when an actuator is disabled in mid-cycle, the entire vending machine is disabled. An actuator can be disabled as a result of an actuator defect, or as a result of a jam in the vending apparatus itself or of the product it is intended to vend. Although attempts have been made to circumvent this problem (see, for example, U.S. Pat. No. 4,220,235), they have employed relatively expensive components associated with each actuator and, therefore, have not been very practical, especially in machines having a large number of actuators.

SUMMARY OF THE INVENTION

The present invention is a vending machine control and diagnostic apparatus which employs an impedance element, such as a resistor or capacitor, associated with each actuator. Each actuator controls a switch which is electrically in series with the impedance element so that the impedance element and the actuator are electrically in parallel when the actuator is at home position, but the impedance element is disconnected from the actuator when the actuator is away from its home position. A measurement of the impedance of an actuator and its associated impedance element, for example, by passing a small current through the actuator circuit where the impedance element is a resistor, is used to diagnose the status of the actuator. In the preferred embodiments the actuators are connected in a matrix arrangement, in which case the required number of drive elements and interconnecting wires is reduced. The present invention is suitable for operation under control of a microprocessor.

Details of my invention, in some of its embodiments, are set forth below:

DESCRIPTION OF THE FIRST EMBODIMENT

Figure 1:
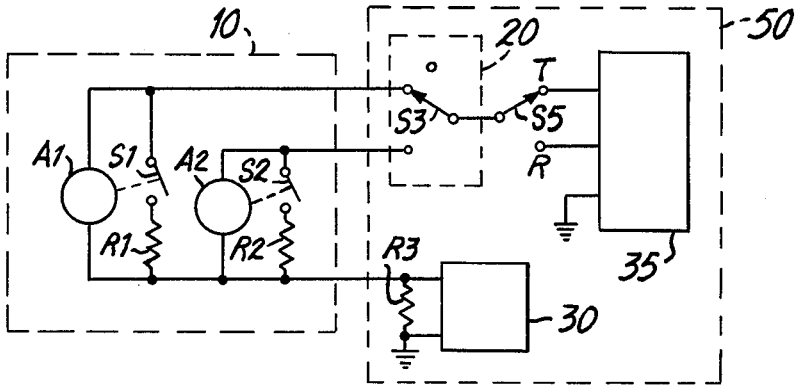
FIG. 1 is a schematic block diagram of a first embodiment of my invention.

FIG. 1 is a schematic block diagram of a first embodiment including a product delivery apparatus 10 and a vending and diagnostic apparatus 50, showing the principles of my invention.

The product delivery apparatus 10 in this embodiment includes two actuators A1 and A2 for use in delivering a selected product. For example, the product delivery apparatus 10 can be a drink dispenser in which actuator A1 releases a cup to be filled and actuator A2 controls the flow of the drink into the cup. It will be clear to those skilled in the art how additional actuators can be employed without departing from my invention. For example, six such actuators could be used for controlling the delivery of cold, canned beverages from a six column beverage machine, using one actuator per column.

Figure 2:
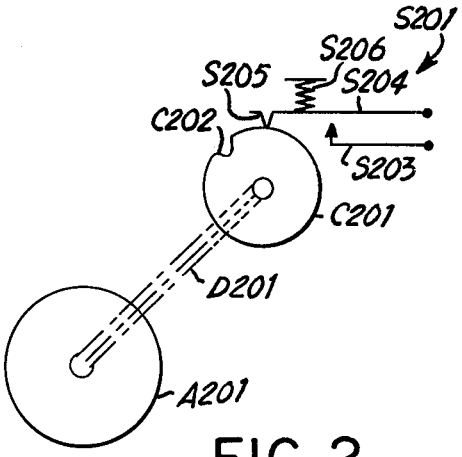
FIG. 2 is a schematic drawing of an actuator, cam and switch suitable for use in the embodiment of FIG. 1.

Associated with each of the actuators A1 and A2 is a switch S1, S2 which is controlled by an associated cam, which in turn is moved by the actuator as shown schematically in FIG. 2. In FIG. 2, the actuator A201 is a rotary motor. It is mechanically coupled by a rotating drive shaft D201 to a cam C201. The drive shaft D201 is also mechanically coupled to drive the product delivery means (not shown). Switch S201 corresponds to the switches S1, S2 of FIG. 1. Switch S201 has a stationary contact S203 and a moveable contact arm S204. The outer end of the contact arm S204 has a protrusion S205 which rests on the surface of the cam C201. A spring S206 presses the protrusion S205 against the cam C201. The cam C201 has an indentation C202 in its surface. When the actuator A1 is at home position, the protrusion S205 is pressed by the spring S206 into the identation C202, connecting switch contacts S203 and S204. When the actuator is not at its home position, the cam C201 holds the switch arm S204 in a position such that it does not contact the fixed contact S203. While the switches S1, S2 and S201 of FIGS. 1 and 2 are shown and described as normally closed when the associated actuators A1, A2 and A201 are in the home position and open when away from the home position, it will be clear to those skilled in the art that a switch which is open when the actuator is in the home position and closed when away from home position can also be employed without departing from my invention.

The use of such cams and switches in connection with actuators, such as rotary motors, is well known in the art. In most such cases, the cam causes a circuit to open whenever the actuator shaft is away from its home or start-stop position, but, unlike the present invention, the cam-actuated switches in such conventional vending apparatus are all wired in series with each other, forming a blocker circuit. Whenever the blocker circuit is opened by any of the cam-operated switches in such an apparatus, the actuation of all other actuators is blocked. In the event an actuator is jammed or becomes inoperative in this position, the vending apparatus cannot operate until repaired. In accordance with the present invention, however, the switches S1, S2 although cam-actuated in similar fashion to the blocker switches of conventional vending apparatus, are connected differently and perform a different function.

Each of the switches S1, S2 is in series with a capacitive or resistive impedance element (a resistor in this embodiment) R1, R2, respectively, and the series connected switch-resistor sets are wired in parallel with the associated actuator A1, A2.

The vending control and diagnostic apparatus 50 includes an actuator selector 20 including a switch S3, a test circuit 30, a test resistor R3, a power supply 35 and a test-run switch S5. The power supply 35 provides two outputs: one the run terminal R providing sufficient power to operate one of the actuators A1 or A2, when it is connected to the run terminal by switch S3 and test-run switch S5, and the other the test terminal T providing a signal insufficient to run the actuator, connected to the test terminal T. When one of the actuators is selected by the actuator selector 20, current can flow from the power supply 35, through the selector switch S3, through the selected actuator A1 or A2, and back to the power supply 35 via the test resistor R3 and ground. When the switch S1 or S2, associated with the selected actuator A1 or A2, is closed; current also flows through the associated resistor R1 or R2.

Test circuit 30 monitors the signal flowing through the selected actuator and its parallel impedance. In one version of this embodiment, the test circuit 30 is a simple voltmeter which monitors the voltage across resistance R3, indicating the current flowing through the resistor R3. By monitoring the current through R3, the test circuit can indicate the conditions of the actuator. When actuator A1 or A2 is away from home, R1 or R2 is switched out of the circuit and all the current flowing through R3 flows through A1 or A2. For a given test voltage from the power supply, there will be a normal range of current drawn by an operating actuator, A1 or A2, away from its home position. At home position, a greater amount will be drawn because the associated switch S1 or S2 will be closed and current will be drawn through both the actuator and the associated impedance element R1 or R2. If the motor is open circuited at home position, only the impedance element will draw current. If the motor is open circuited away from home position, no current will be drawn. If the motor is short circuited, the maximum amount of current will be drawn.

DESCRIPTION OF THE SECOND EMBODIMENT

Figure 3:
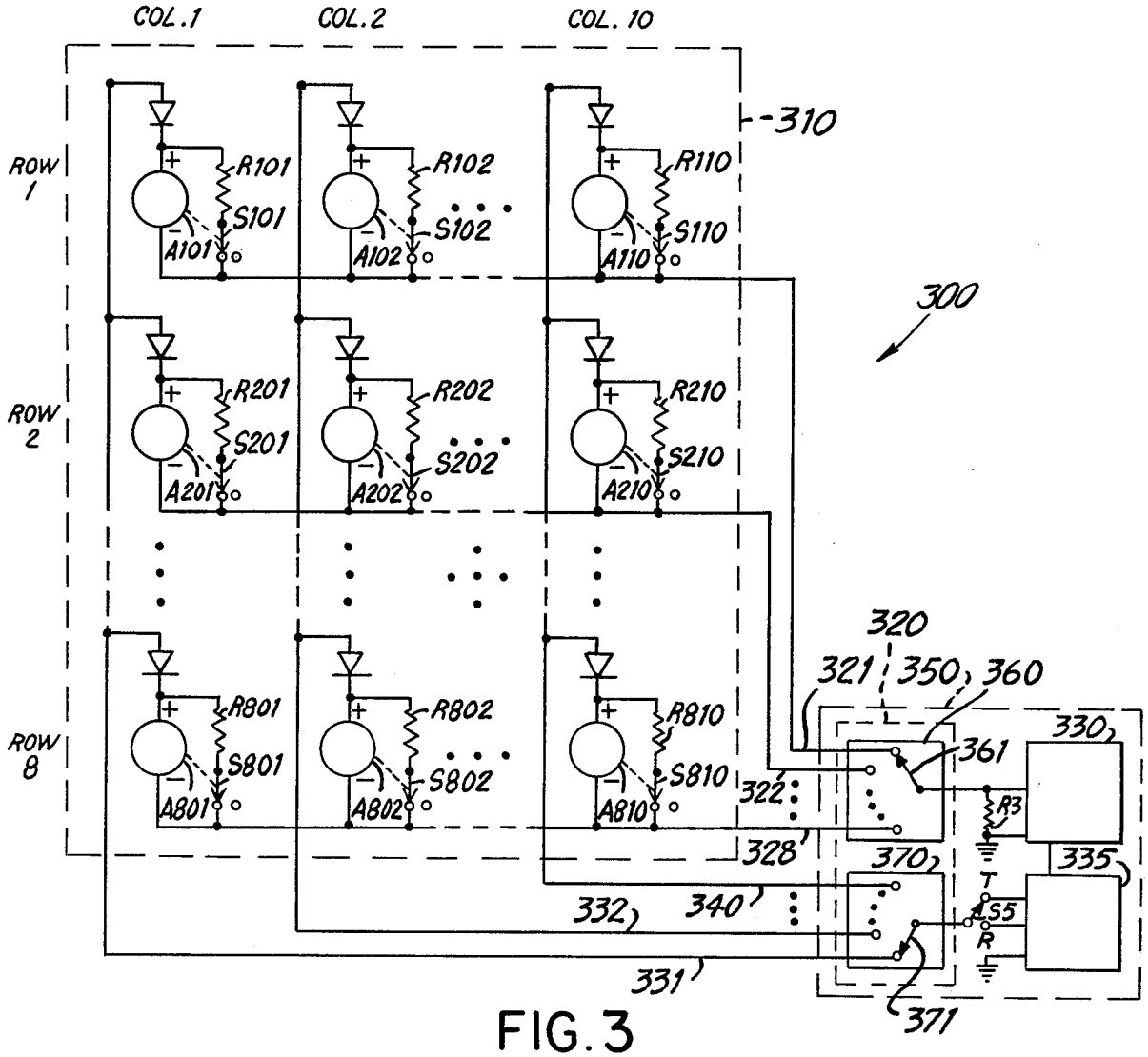
FIG. 3 is a schematic block diagram of a second embodiment of my invention.

FIG. 3 is a schematic diagram of a second embodiment including a product delivery apparatus 310 and a vending control and diagnostic apparatus 350, showing the principles of my invention.

The product delivery apparatus 310 includes eighty actuators A101–A810, such as rotary motors or solenoids, used for delivering products in a vending machine. For the purpose of illustration, it will be assumed in this specification that the actuators A101–A810 are direct current (DC) rotary motors, unless otherwise noted, although my invention is not limited to the use of such rotary motors as the actuators.

The actuators A101–A810 are arranged in a matrix of eight rows and ten columns. The desired actuator is selected by the actuator selector 320 within the vending control and diagnostic apparatus 350. One terminal, the negative terminal, of each of the actuators A101–A110 in Row 1 is connected with the corresponding terminal of the other actuators A101–A110 in the same row by a row drive line 321 to a row switch 361 within row switching means 360, which is a part of the actuator selector 320. Similarly, one terminal, the negative terminal, of each of the actuators A201–A210 . . . A801–A810 in Rows 2 through 8 is connected by the row drive lines 322 through 328 to the switch 361. The row drive switch 361, when connected to one of the row drive lines 321–328, connects the row drive line selected by the row drive switch 361 to resistor R3, the other end of which is connected to ground. The positive terminals of each of the actuators A101, A201 . . . 801 in Column 1 are connected by a column drive line 331 to a column switch 371 within the column switching means 370. Similarly, the positive terminals of each of the actuators in Columns 2 through 8 are connected by the column drive lines 332 through 340 respectively to switch 371. The column drive switch 371, when connected to one of the column drive lines 331–340, will connect the column drive line selected by the column drive switch 371 to switch S5.

Switch S5 has two positions in this embodiment. In the run position (R), the arm of the switch S5 is connected to a 24VDC output of the power supply 335 which provides sufficient power to operate an actuator. In test position (T), the arm of the switch S5 is connected to an output of the power supply 335 providing a signal sufficient for testing the product delivery apparatus 310, but insufficient in some respect, such as voltage, duty cycle or possessing only an AC component, to actuate the actuator to which it is connected. In this example, the test voltage is 5VDC.

When any combination of row and column is selected by the switching means 360 and 370, and switch S5 is in the run position (R), the actuator at the intersection of the column and row selected will be actuated. Under normal operating conditions, this will cause a product to be vended in the conventional fashion. For example, when row 1 and column 1 are selected, actuator A101 is actuated by current flowing from the power supply 335 through column switch 371 via column drive line 331 through the actuator A101 via row drive line 321 and row switch 361 through resistor R3 to ground.

Associated with each of the actuators A101–A810 is a switch S101–S810 which is controlled by an associated cam, which in turn is moved by the actuator as shown schematically and described in connection with FIG. 2. Each of the switches S101–S810 is connected in series with one of impedance elements (resistors in this embodiment) R101–R810, respectively and the series connected switch-resistor sets are each wired in parallel with the one of the actuators A101–A810, respectively. A diode is connected in series with each such actuator, impedance element and switch combination to assure proper matrix control.

The circuit arrangement just described permits the diagnosis of the status of any of the actuators A101–A810 by observation of the impedance in the appropriate drive lines. Any particular actuator may be selected for testing by selection with the row and column switches 361 and 371 and application via switch S5 of the test signal from the power supply 335. In the particular system 300 shown in FIG. 3, the measuring circuit 330 comprises a simple voltmeter across resistor R3, which gives an indication of the current flowing through the matrix of product delivering apparatus 310. That current is dependent upon the position of the row and column switches 361 and 371, the resistances of the selected actuator and corresponding impedance element, and the position of the corresponding cam-actuated switch.

Various possible conditions of an actuator are described below together with the currents which would indicate the condition in this embodiment.

In this particular embodiment, in which the nominal operating actuator resistances are each 200 ohms, the resistances of the associated impedance elements R101–R810 are each 300 ohms, the resistance of R3 is 20 ohms and the test signal is a 5VDC signal which is insufficient to actuate the actuator being tested; the measuring circuit 330 will indicate currents flowing through R3 as follows:

(a) If the motor is open-circuited and in mid-cycle (opening its associated switch), or if the associated diode is open-circuited, the current will be 0 milliamperes.

(b) If the motor is open-circuited and at the home position, the current will be approximately 13.8 milliamperes.

(c) If the motor is in mid-cycle (opening its associated switch), but not open- or short-circuited, the current will be approximately 20 milliamperes.

(d) If the motor is at its home position, but not open- or short-circuited, the current will be approximately 31.4 milliamperes.

(e) If the motor is short-circuited or the associated resistor is short-circuited (the latter being less likely), the current will be well in excess of 31.4 milliamperes. For this reason, current limiting means should be incorporated in the power supply 335 or another appropriate part of the apparatus.

In order to provide automatic detection of any defective actuators and actuators which are not at their home position, the control and diagnostic apparatus 350 can be provided with automatic switching means such as the switching means 360 and 370, and the measuring circuit 330 can be arranged to indicate when the current flow through resistor R3 is other than the current which occurs when a normal actuator is at its home position. The third embodiment described below provides such automatic detection.

Figure 4:
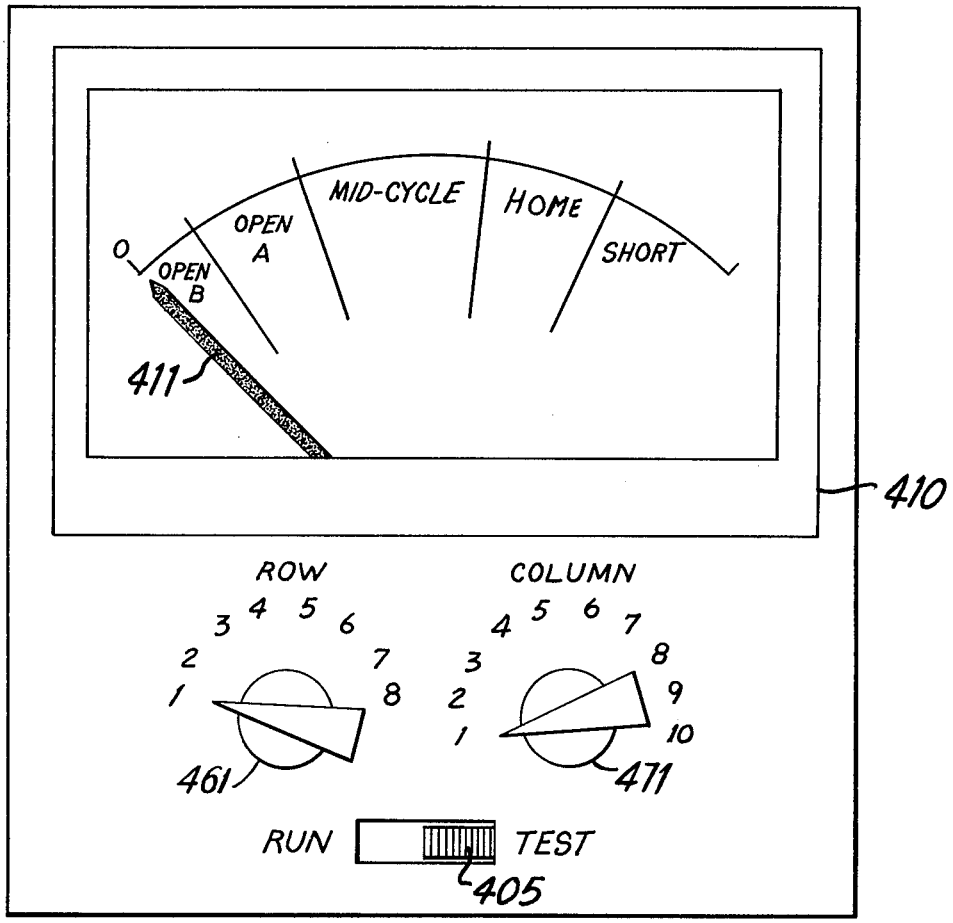
FIG. 4 is a front view of a control panel suitable for the embodiment of FIG. 3.

FIG. 4 shows a test control panel 400 suitable for the embodiment of FIG. 3. It includes a meter 410 which serves as part of the measuring circuit 330. The knobs 461 and 471 are connected to operate the moveable contacts of row and column switches 361 and 371, respectively. Switch 405, corresponding to switch S5 of FIG. 1, which is used for switching between the run or operate mode and the test mode, is also located on the test control panel 400. When switch 405 is in the test mode, the needle 411 of the meter indicates the current passing through resistor R3. In the test control panel 400 shown in FIG. 4, the meter face bears designations for various conditions so that the person testing the vending system is readily apprised of the condition of an actuator. These designations are short form versions of the conditions discussed in connection with FIG. 3 above. The meter face can also be calibrated in milliamperes or some other appropriate values.

In many vending machines now being sold, the vending control system simply starts the selected actuator. Once the actuator has moved a small distance, a first cam-operated blocker switch is opened to prevent the actuation of other actuators and a second cam-operated switch connects the selected actuator directly to the power source until the actuator returns to its home position. This type of cam-operated switch can be employed with the apparatus of my invention, but is not the preferred arrangement.

I prefer to provide logic means for monitoring the actuator impedance conditions and controlling the actuator. For example, a logic circuit is provided within the measuring circuit 330 of FIG. 3 for monitoring the current through resistor R3 and making logical decisions in response thereto. When a product is selected, the measuring circuit 330 first determines that the selected actuator is at home position and operable. This is done by causing the power supply 335 to apply the test current. If the actuator is at home position and operable, the measuring circuit 330 causes the power supply 335 to apply full run current. Under normal conditions, when run current is applied, the measuring circuit 330 first detects the large amount of current drawn by the actuator and its parallel resistor. Shortly after the run current is applied, the measuring circuit 330 should detect a reduction of current as the resistor is disconnected by its associated cam-operated switch. This indicates that the actuator has moved away from home position. When the actuator returns to home position again, the measuring circuit 330 will detect a large increase in current as the resistor is again connected in parallel with the actuator. In response, the measuring circuit 330 will cause the power supply 335 to remove the run current. The measuring circuit 330 also includes a timing circuit which causes the power supply 335 to remove the run current if the actuator does not return to its home position within a predetermined normal period of time from actuation.

Figure 5:
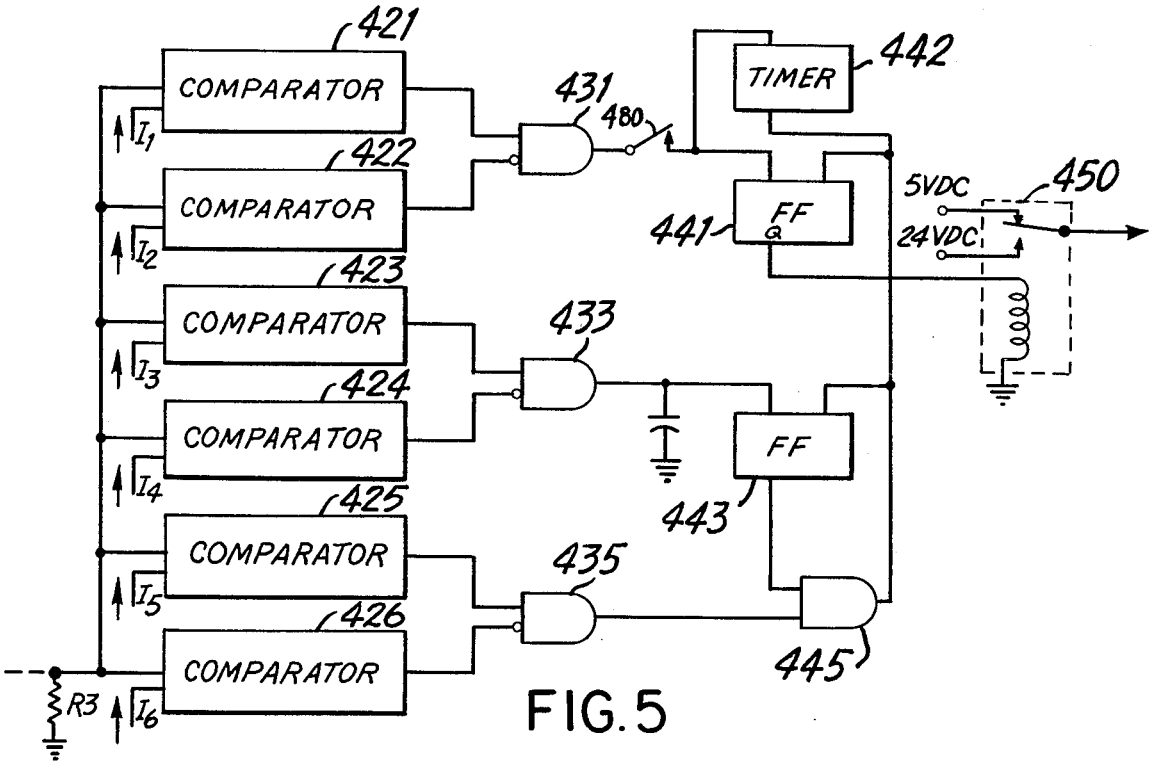
FIG. 5 is a schematic block diagram of a comparator circuit suitable for the embodiment of FIG. 3.

One way in which this logical function can be accomplished is shown in FIG. 5. A group of comparators 421–426 monitor the current flowing through resistor R3 and each compares that current to a different standard current I1–I6 from a source (not shown) such as power supply 335 of FIG. 3. The standard currents for comparators 421 and 422 bracket the acceptable range of test current for a normal actuator at home position. If comparators 421 and 422 indicate that the current is within that range by a logical "1" from comparator 421 and a logical "0" from comparator 422, AND gate 431 produces a signal which sets flip-flop 441 when the start switch 480 is momentarily depressed. This signal also triggers timer circuit 442 (such as a monostable multivibrator) to control the maximum actuator cycle time. When flip-flop 441 is set, the signal from its Q output activates a relay 450, corresponding to switch S5 in FIG. 3. When unactivated, this relay 450 provides test current (5VDC here) to the product delivering apparatus 310 via the column switching means 370. When the relay 450 is activated, full run current (24VDC here) is applied.

When the full run current is first applied to an actuator, the current drawn is high, determined by the resistor in parallel with the actuator and R3. Comparators 425 and 426, which compare the matrix circuit current with standard currents bracketing the acceptable currents for this condition, detect the high current condition, causing AND gate 435 to send a signal to AND gate 445. Flip-flop 443, however, is in the reset state from a prior cycle and is not sending a signal to AND gate 445; therefore, AND gate 445 does not produce an output signal at this time.

When the actuator switch disconnects the parallel resistor, the current through R3 drops to normal running current. This condition is detected by comparators 423 and 424 which compare the matrix current with standard currents bracketing the acceptable running current range. When the current through R3 is in this range, AND gate 433 produces a signal which sets flip-flop 443. When the actuator returns home and the actuator's associated parallel resistor is again connected, the R3 current increases to the high level observed when full run current is first applied. This time, the signal produced from AND gate 435 is concurrent with a signal from flip-flop 443, and AND gate 445 sends a signal to reset flip-flop 441. The output of flip-flop 441 which then occurs causes the relay 450 to return to the test current condition. The signal from AND gate 445 also resets flip-flop 443 and the timer 442, preparing them for another cycle.

In the event that the actuator cycle is not completed within a predetermined normal period, it is likely that the selected actuator is jammed or defective. In order to avoid damage to the apparatus, the timer 442 will reset flip-flops 441 and 443 if the end of that predetermined period is reached before the actuator cycle is completed, thus removing the run current and ending the cycle.

DESCRIPTION OF THE THIRD EMBODIMENT

Figure 6:
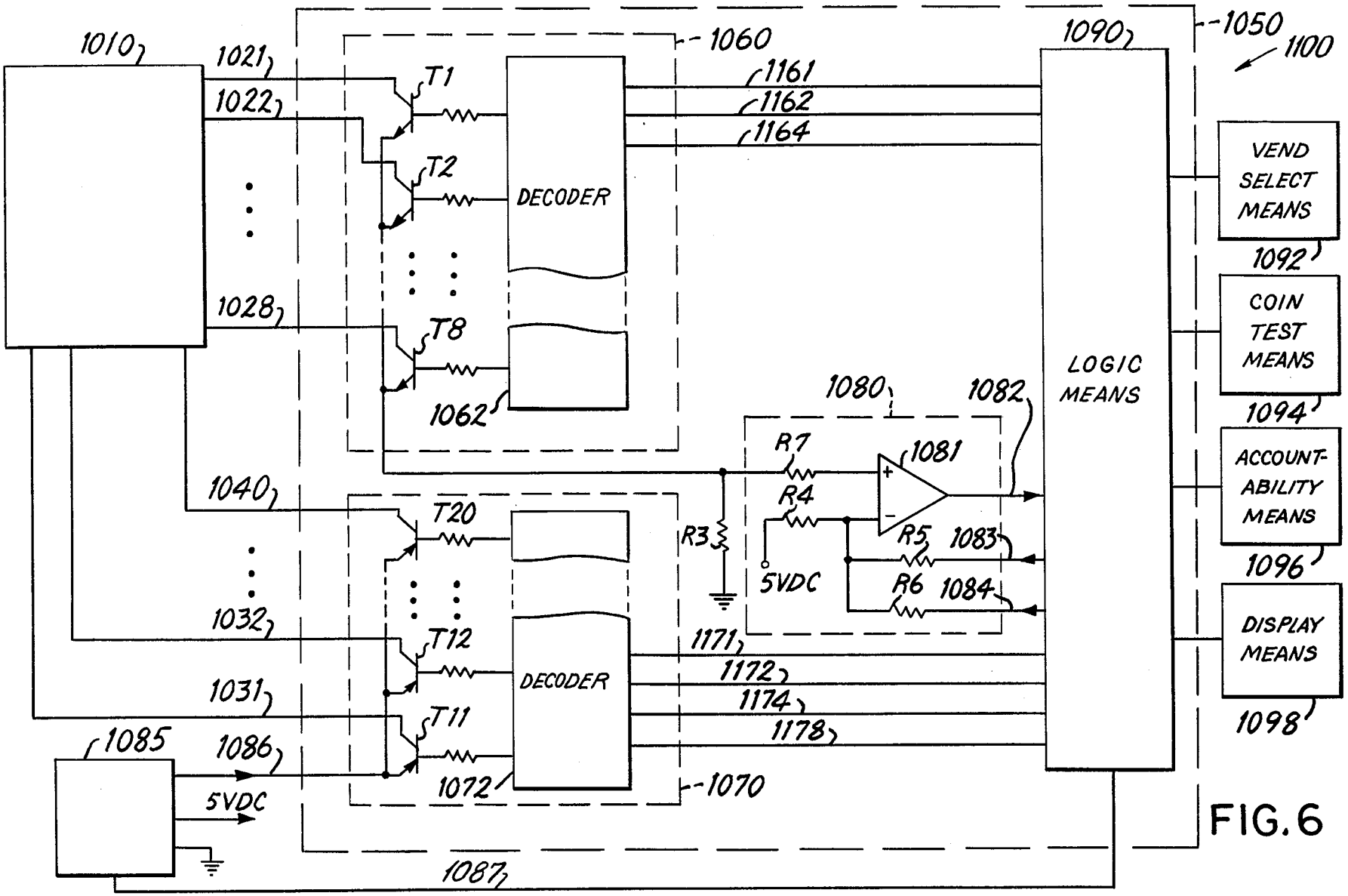
FIG. 6 is a schematic block diagram of a third embodiment of my invention.

FIG. 6 shows a third embodiment of a vending machine control and diagnostic apparatus 1050 in accordance with my invention. The product delivery apparatus 1010 is of the same construction as the product delivery apparatus 310 of the second embodiment. Associated with the apparatus 1100 are vend select means 1092, coin test means 1094, accountability means 1096, and display means 1098.

The control system 1050 of the apparatus 1100 may be used in place of the control system 350 of the second embodiment without departing from my invention. The outputs of the control system 1050 to the product delivery apparatus 1010 are row signal lines 1021–1028, corresponding to row signal lines 321–328 of the second embodiment, and column signal lines 1031–1040, corresponding to column signal lines 331–340 of the second embodiment. The row and column selection functions are performed by row switch means 1060 and column switch means 1070, respectively. These employ transistors T1–T8 and T11–T20, respectively, to switch the current through a selected row and column to the actuator at the row and column intersection, as already explained in connection with the second embodiment.

Each of the row and column switch means 1060 and 1070 receives control signals from a logic circuit means 1090, which could be a hardwired logic circuit or a programmed data processor, such as a microprocessor, or other logic circuit capable of performing the required functions as outlined herein. An Intel type 8035 microprocessor is suitable for use as the logic circuit 1090. The control signals from the logic circuit 1090 in this embodiment are transmitted in binary digital form on row control wires 1161, 1162 and 1164, and on column control wires 1171, 1172, 1174 and 1178. Each of the switching means 1060 and 1070 includes a decoder 1062 and 1072, respectively, to decode in conventional fashion the binary signals on the row and column control wires from the logic circuit 1090 into single wire signals to drive the base of a selected transistor in each of the groups T1–T8 and T11–T20. Each of the transistors T1–T8 and T11–T20 is connected to an output of the decoder by a base resistor, having a value selected so that the decoder output will supply sufficient current to fully turn on the transistor.

When the logic circuit 1090 transmits a control signal to select a given actuator, such as actuator A101 shown in FIG. 3, the logic circuit 1090 transmits binary row and column signals. In this example, to select actuator A101, the row signal is 000 and the column signal is 1010. To select actuator A810, the row signal is 111 (equivalent to decimal 8) and the column signal is 1001 (equivalent to decimal 10). The decoders 1062 and 1072 translate these binary control signals into line control signals, actuating transistors T1 and T11 in the case of the first example, and actuating transistors T8 and T20 in the case of the second example.

When actuated, transistor T1 connects the negative side of the actuators A101–A108 of row 1 to ground through a resistor R3, which is a 20 ohm resistor in this embodiment. When transister T11 is actuated, it connects the positive side of the actuators A101–A801 in column 1 by way of line 1086 to power supply 1085. Supply 1085 provides either a +24VDC power source or a test current source. Logic means 1090 provide a control signal via line 1087 which determines whether +24VDC or the test current source is supplied on line 1086. When the + terminal of actuator A101 in this fashion, is connected to +24VDC and its − terminal is connected through resistor R3 to ground, it is actuated and proceeds through a vend cycle in the usual fashion. Similarly, the actuator can be connected in the same fashion to the test current source, such as the 5VDC output of the power supply 1085.

The measuring circuit 1080 monitors the flow of current through the selected actuator and its associated parallel impedence (if any) and, in this embodiment, provides a digital indication of the status of the selected actuator. In the measuring circuit 1080 of FIG. 6, a comparator 1081 typically a National Semiconductor type LM3900, compares the current through a 10 kilohm resistor R7 at its + input with standard signals applied at its − input. When the magnitude of the current at the + input exceeds that of the current at the − input, then the output of the comparator 1080 on wire 1082 is a logical "1". Otherwise, the output of the comparator 1080 on wire 1082 is a logical "0". Wires 1083 and 1084 from the logic circuit 1090 are employed as a digital-to-analog converter circuit to apply four different standards or currents to the − input of the comparator 1081 by selectively connecting the resistors R5 and R6 to either a logical "1" (+5VDC) or a logical "0" (0VDC). As a result, the output on wire 1082 of the comparator 1081 indicates the range of actuator current conditions from lower than the lowest standard current to higher than the highest standard current.

Table I below shows typical currents for various actuator conditions and the four standard current conditions obtained when R7 is 10 kilohms, R4 is 120 kilohms (passing 37 uA), R5 is 52 kilohms (passing 85 u A) and R6 is 22 kilohms (passing 200 u A). 4.4 volts is used instead of 5 volts in computing the current because of the 0.6 volt drop across the emitter-base diode in series with each comparator input. A run voltage of 24VDC is employed.

TABLE I

| Condition | Current (uA) | 1083 Level | 1084 Level |
|---|---|---|---|
| Diode or Wire Open or Motor Open in Mid-Cycle | 0 | | |
| First Standard | 37 | 0 | 0 |
| Open Actuator | 90 | | |
| Second Standard | 122 | 1 | 0 |
| Actuator in Mid-Cycle | 158 | | |
| Third Standard | 237 | 0 | 1 |
| Actuator Operable and Home | 283 | | |
| Fourth Standard | 322 | 1 | 1 |
| Actuator Shorted | 322 | | |

In order to test an actuator, the logic circuit 1090 first selects the actuator, as previously described, and then quickly produces each of the four combinations of logic levels on wires 1083 and 1084, while monitoring the logic level on wire 1082. This procedure applies each of the standard currents to the − input of the comparator 1081. If the test is conducted when the actuator being tested should be at the home position, the output of the comparator 1081 on wire 1082 should be a logical "1" when the first, second and third standards are applied, and a logical "0" when the fourth standard is applied.

Alternatively, the logic levels producing the third and fourth standards (which bracket the current of a normal actuator at home position) can be applied first. If a logical "1" is obtained on wire 1082 when the third standard current is applied to the comparator 1081 and a logical "0" is obtained when the fourth standard is applied, the test indicates that the actuator is normal and at home position. As a result, when this indication is obtained, it is not necessary to test for other possible conditions of the actuator.

The possibility of a jam is indicated when the test indicates that the motor is normal, but in mid-cycle when it should be at home position. Before indicating a malfunction, the logic circuit automatically applies operating current to the actuator in question for a sufficient period of time for the actuator to complete its cycle—typically three seconds. If the malfunction still exists, the identity of the actuator and the nature of the malfunctions are indicated on the display.

Figure 7:
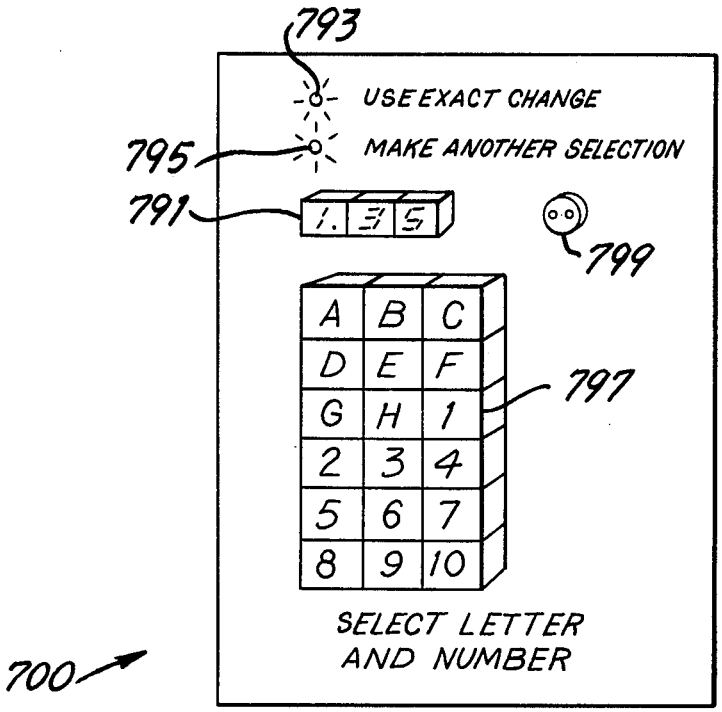
FIG. 7 is a front view of a control panel suitable for the embodiment of FIG. 6.

FIG. 7 shows the front control panel 700 of a vending machine incorporating the third embodiment of my present invention. The control panel 700 of this embodiment includes a three digit display 791, such as a light emitting diode display, for displaying up to $9.95 of credit to the customer and for displaying test information to system maintenance personnel. This display 791 is a part of the display means 1098 of FIG. 6. The control panel 700 also includes an illuminated exact change indicator 793, which preferably is operated by a system of the general type disclosed in my U.S. Pat. No. 4,188,961, in which exact change is not requested unless the machine cannot give correct change for the user's credit and product selection.

The front control panel 700 also includes an illuminated "Make Another Selection" indicator 795 to advise the user when the selected product is not available or the actuator for that product is inoperable. An optical coupler 799 for reading information stored in the accountability means 1096 of FIG. 6 is also provided.

The front control panel 700 also includes a selection means comprising an array 797 of eighteen push button switches. These are part of the vend select means 1092 of FIG. 6. The switches labeled A through H select the rows of products (corresponding to actuator rows 1 through 8). The switches 1 through 10 select the columns of products (corresponding to the actuator columns).

I prefer to use two separate groups of switches, such as a letter and number combination as shown in FIG. 7, to identify the row and column of the selected actuator; instead of depending upon sequential entry of two identifying signals with the same group of switches as in shared switch systems. This makes it easier for a customer to change his mind without receiving the wrong product. For example, in a shared switch-system, if the customer enters a "2" to select a product in row 2 and then decides to purchase a product in row 4; he must somehow signal the system that he wishes to start over. If he simply enters a "4", having already entered a "2" he will receive the product at row 2, column 4; which is not the one he intended. When separate switches are employed for column and row selection, the selection means and logic circuit can be arranged to accept only a combination of a signal from one set of switches (labeled A through H here) in sequence with a signal from the other set of switches (labeled 1 through 10 here.) As a result, a change in choice from the second to the fourth row would cause the customer to first press "B" and then press "D". The system will automatically ignore the first signal from the lettered switch ("B" in this case) if a signal from another lettered switch ("D" in this case) is received and will await a column selection signal from the switches labelled 1 through 10 before completing the transaction.

DESCRIPTION OF THE FOURTH EMBODIMENT

Figure 8:
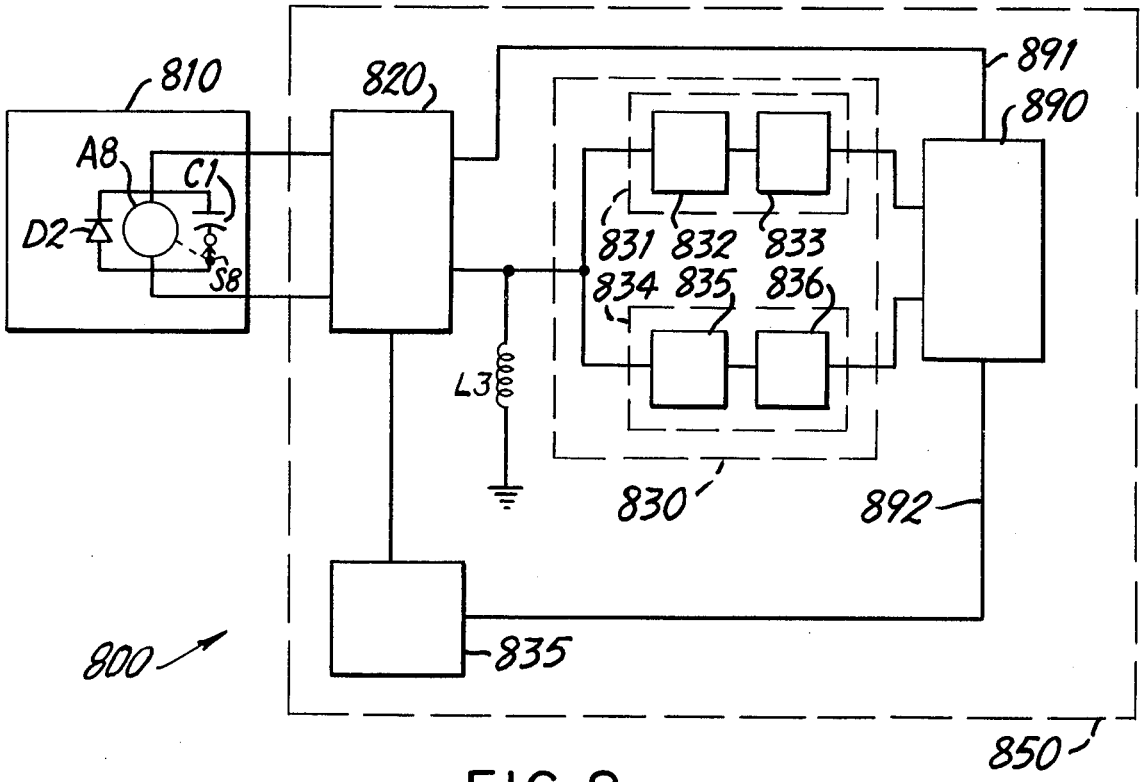
FIG. 8 is a schematic block diagram of a fourth embodiment of my invention.

FIG. 8 is a generic schematic block diagram of a fourth embodiment of a vending system 800 incorporating a vending machine control and diagnostic apparatus 850 in accordance with my invention. The product delivery apparatus 810 is of similar construction to the product delivery apparatus 310 and 1010 of the second and third embodiments. The differences will be explained below in connection with FIGS. 8 & 9. Only one of the actuators A8 and its associated components is shown in FIG. 8; however, it will be clear to those skilled in the art how additional actuators can be employed in connection with this embodiment.

Controlling the product delivery apparatus 810 the vending control and diagnostic apparatus 850. Included within that apparatus 850 are an actuator selector 820, a test circuit 830, a power supply 835, and a logic circuit 890 whose functions generally correspond to the similarly named components of the previously described embodiments. The apparatus 850 also includes an inductor L3 in place of the resistor R3 of the previously described embodiments. The product delivery apparatus 810 incorporates an actuator A8. In parallel with the actuator A8 is a series connected switch S8 and impedance element, capacitor C1. The switch S8 is operated by the actuator A8 in a similar fashion to that previously described in connection with the other embodiments. Also in parallel with the actuator A8 is a diode D2 which is provided to reduce switching noise.

The principal difference of this embodiment from those previously described is that it employs an AC test signal, whereas the previously described embodiments employ a DC test signal.

The logic circuit 890 sends selection signals via wire 891 to the actuator selector 820, causing it to connect one terminal of the desired actuator to the power supply 835 and the other terminal to inductor L3 and the test circuit 830. The logic circuit 890 also controls the output of the power supply 835 via signals on wire 892.

The power supply 835 produces an AC test signal and a running or power current which is either DC or a different frequency (usually lower) AC than the test signal. The test circuit 830 is arranged to distinguish between the test and running currents. The test circuit 830 includes a run signal detector 831, incorporating a frequency filter 832 and a run signal detection circuit 833, and a test signal detector 834 incorporating a frequency filter 835 and a test signal detection circuit 836. The manner of operation of the embodiment will be explained in greater detail in connection with one version of this embodiment shown in FIGS. 9 and 10.

Figure 9:
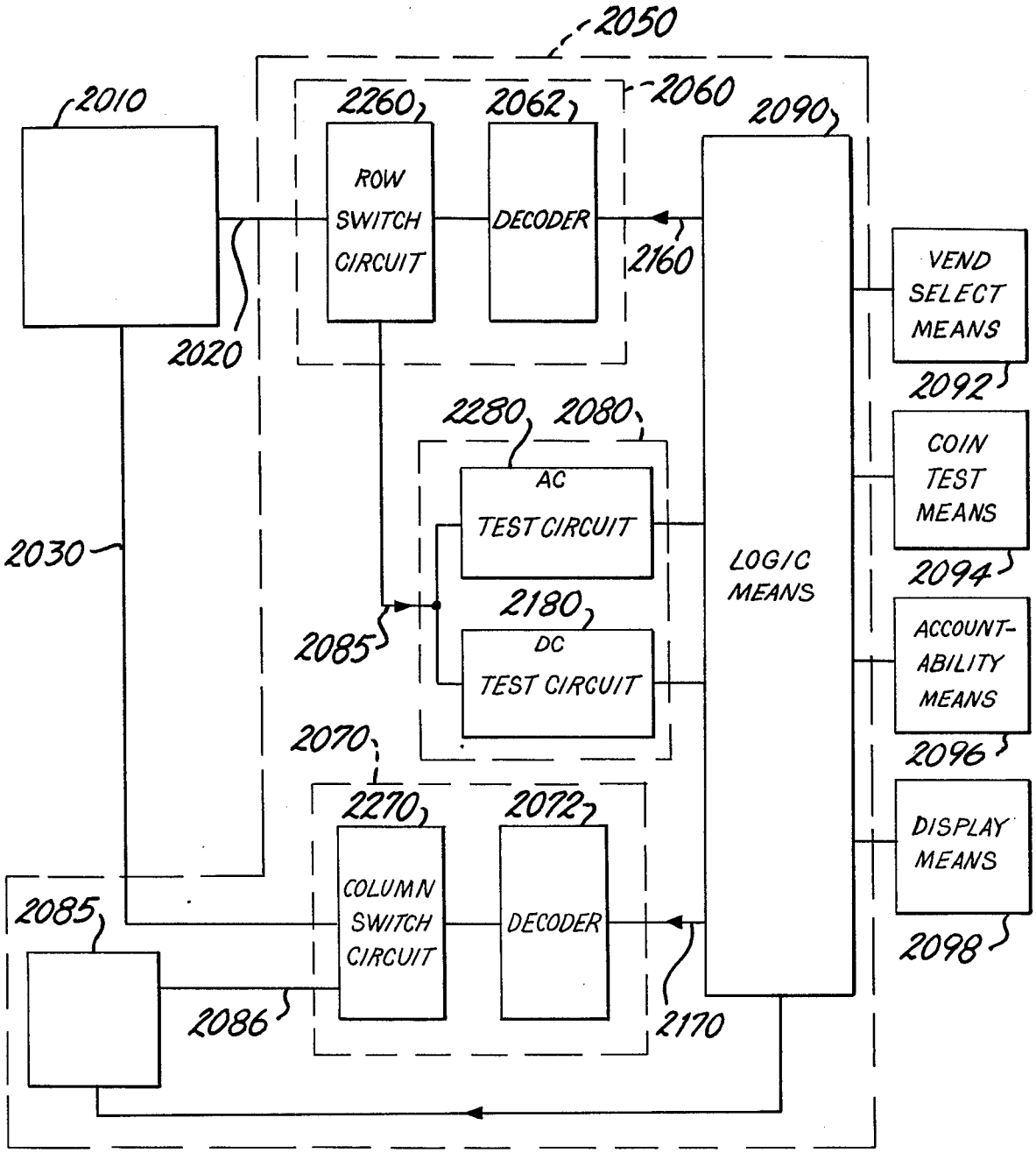
FIG. 9 is a schematic block diagram of a version of the embodiment of FIG. 8.

FIG. 9 is a schematic block diagram of one version of the fourth embodiment of FIG. 8 which is arranged for control of a product delivery apparatus 2010 having a matrix of actuators. Associated with the apparatus 2100 are vend select means 2092, coin test means 2094, accountability means 2096, and display means 2098, each corresponding to the similarly named elements described in connection with the third embodiment. The control system 2050 of the apparatus 2100 corresponds to the control system 350 of the second embodiment of my invention described above. The vending control and diagnostic apparatus 2050 controls the product delivery apparatus 2010.

Like the second and third embodiments, the outputs of the control system 2050 are connected to the product delivery apparatus 2010 by row and column signal lines 2020 and 2030. The row and column selection functions are performed by row switch means 2060 and column switch means 2070, respectively. Each of the row and column switch means 2060 and 2070 receives control signals from a logic circuit means 2090, which can be constructed in any of the ways previously discussed. Each of the switching means 2060 and 2070 includes a decoder 2062 and 2072, respectively, to decode in conventional fashion the binary signals on the row and column wires 2160 and 2170 from the logic circuit 2090 into a form appropriate to drive the selected row switch and column switch circuits 2260 and 2270.

Figure 10:
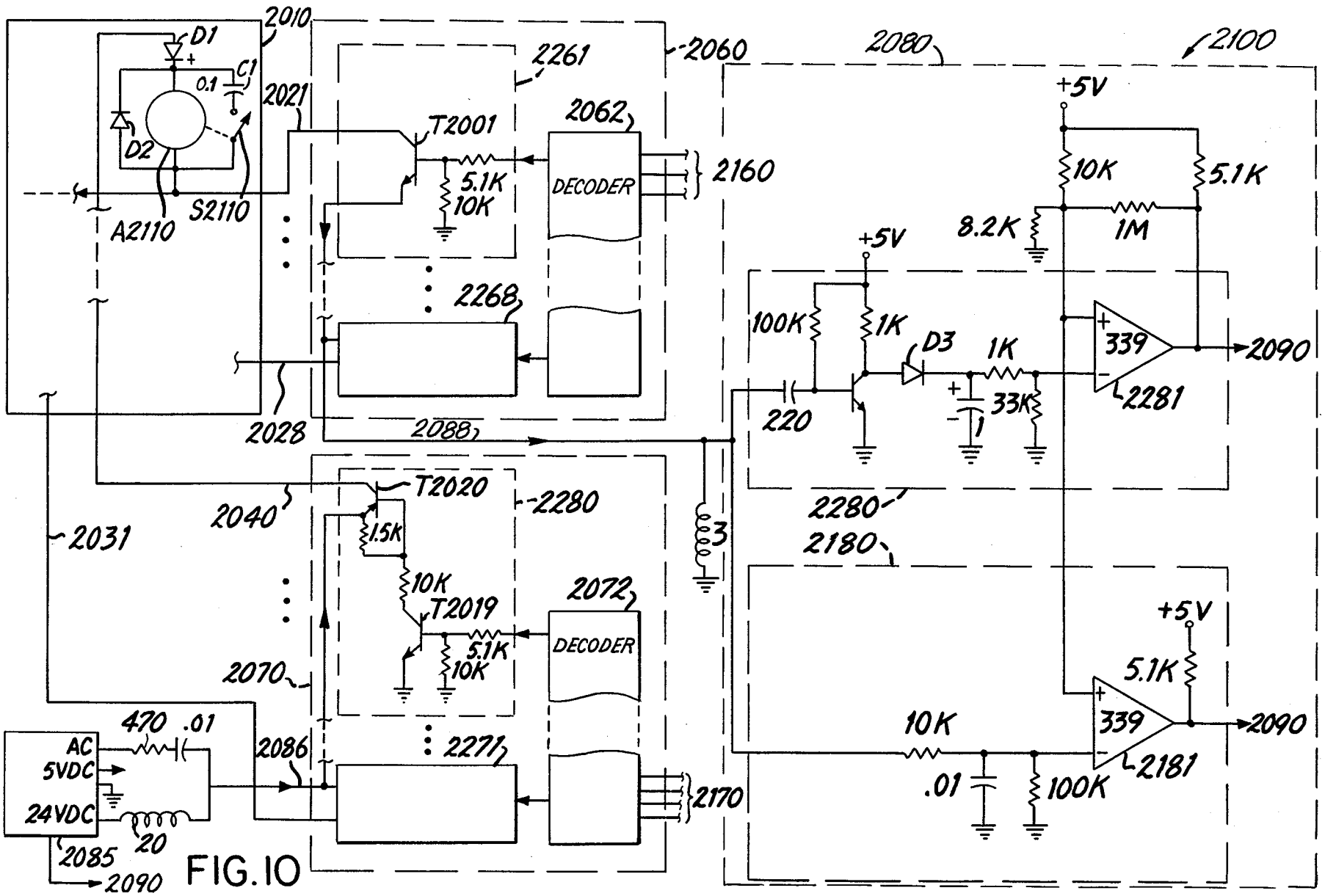
FIG. 10 is a schematic block diagram of test circuits, actuator selection circuits and a product delivery apparatus suitable, for the embodiment of FIG. 9.

FIG. 10 shows details of DC and AC test circuits 2180 and 2280, row and column switch means 2060 and 2070, power supply 2085, and a product delivery apparatus 2010 suitable for this fourth embodiment.

The product delivery apparatus 2010 includes at least one product delivery DC actuator A2110, such as a rotary motor. Like the actuators of the previous embodiments, the actuator A2110 is in parallel with a series connected switch S2110 and impedance element, but in this case the impedance element is a 0.1 ufd capacitor C1. Also in parallel with the actuator A2110 is a diode D2. Although only one actuator A2110 is shown in FIG. 10, it will be clear to those skilled in the art that a plurality of actuators can be connected in a matrix arrangement like that of FIG. 3 in which actuator A2110 would be the actuator in the first row and the tenth column, the position corresponding to that of actuator A110 in FIG. 3. In cases of matrix arrays, a diode D1 corresponding to the series diodes of FIG. 3, would be connected in series with each motor as shown in FIG. 10.

The selection of the actuator is accomplished in the same way disclosed with respect to the third embodiment. The logic circuit 2090 not shown in FIG. 10 transmits row and column select signals along lines 2160 and 2170 to the row and column switch means 2060 and 2070. If these signals are coded in a way not appropriate for direct control of the row and column switch circuits 2260 and 2270, they are decoded by the decoders 2062 and 2072. Only one of each of the individual row and column switches 2261–2268 and 2271–2280 is shown in detail in FIG. 10, row switch 2261 controlling row 1 and column switch 2280 controlling column 10. The row and column switches 2262–2268 and 2271–2279 are of similar constructions. Each of these switches 2261–2268 and 2271–2280 is a conventional type of transistor switch circuit, the operation of which will be clear from FIG. 10 to those skilled in the art.

The power supply 2085 in this version includes the 5 and 24VDC sources of the previous embodiments and a source of alternating current (AC). Suitable AC for this embodiment is 100 to 200 kilohertz at 5 volts RMS. Unlike the previous embodiments in which 5VDC is used as the test signal, in this embodiment the 5VDC is used solely as a power source for some of the circuits. The test signal is the AC signal. The AC signal and the 24VDC signal are combined on a single wire. Appropriate blocking means are provided comprising a 20 millihenry inductor in the 24VDC line and a series connected 470 ohm resistor and 0.01 ufd capacitor in the AC line. The combined AC/24VDC signal is then supplied via line 2086 to each of the column switches 2271–2280. As shown in the case of column switch 2280, when that switch receives a signal from the logic means 2090 via the column decoder 2072, transistor T2020 is switched to a conducting state, thereby permitting the AC/24VDC signal to pass via line 2040 to the actuators in column 10 of the product delivery means 2010. The row switches 2261–2268 connect to the other side of the actuators from the column switches 2271–2280. When a row switch, such as switch 2261, is activated by a signal from the logic means 2090 as decoded by row decoder 2062, the AC/24VDC signal flows through the actuator via line 2021 and the switching transistor T2001. The 3 millihenry inductance permits most of the DC current to flow to ground, completing the DC power circuit for the actuator, but it blocks the AC signal which passes (along with a small portion of the DC signal) to the test circuit 2080.

The test circuit 2080 in this embodiment comprises a DC test circuit 2180 and an AC test circuit 2280. The DC test circuit simply compares the DC current at one input of its comparator 2181 with a reference current from a divider circuit. A 10 kilohm series resistor and a 0.01 ufd capacitor at the input of the DC test circuit 2180 block the AC signal.

The AC test circuit first blocks the DC component of the signal with a 220 pfd series capacitor, then amplifies the AC portion of the signal with a transistor amplifier, detects the signal with a diode D3, filters the resulting direct current with an RC filter and applies it to the comparator 2281 for comparison with the reference current from the divider circuit.

When the AC/24VDC signal is first applied to an actuator at home position, such as actuator A2110, the corresponding motor switch S2110 is open. The inductance of the motor blocks the AC component of the signal and, therefore, only a DC component appears on line 2088 at the input to the test circuit 2080. As a result, the output of the DC test circuit 2280 is 0 volts, logical "0" and the output of the AC test circuit is 5 volts, a logical "1".

When the actuator A2110 begins to move, switch S2110 is closed. As a result, the AC signal can pass through C1 the 00.1 ufd capacitor which is in series with switch S2110 and both AC and DC components will appear on line 2088 at the input to the test circuit 2080. As a result, a logical "0" will appear at the output of both the DC and AC test circuits 2180 and 2280.

When the actuator A2110 returns to home position, the switch S2110 opens and the AC test circuit output returns to "1". This signals the logic means 2090 to transmit a signal to the power supply 2085 to cut off the power. When this is done, the outputs of both test circuits 2180 and 2280 revert to "1".

It will be clear from the forgoing discussion that the outputs of the two test circuits 2180 and 2280 are indicative of the status of the selected actuator. The indications are summarized in the following table II.

TABLE II

| 2180 (DC) | 2280 (AC) | CONDITION |
|---|---|---|
| 1 | 1 | Power off or open circuit in motor at home |
| 0 | 1 | Motor home and conducting |
| 0 | 0 | Motor away from home and conducting |
| 1 | 0 | Open circuit in motor away from home |

DESCRIPTION OF THE FIFTH EMBODIMENT

Figure 11A:
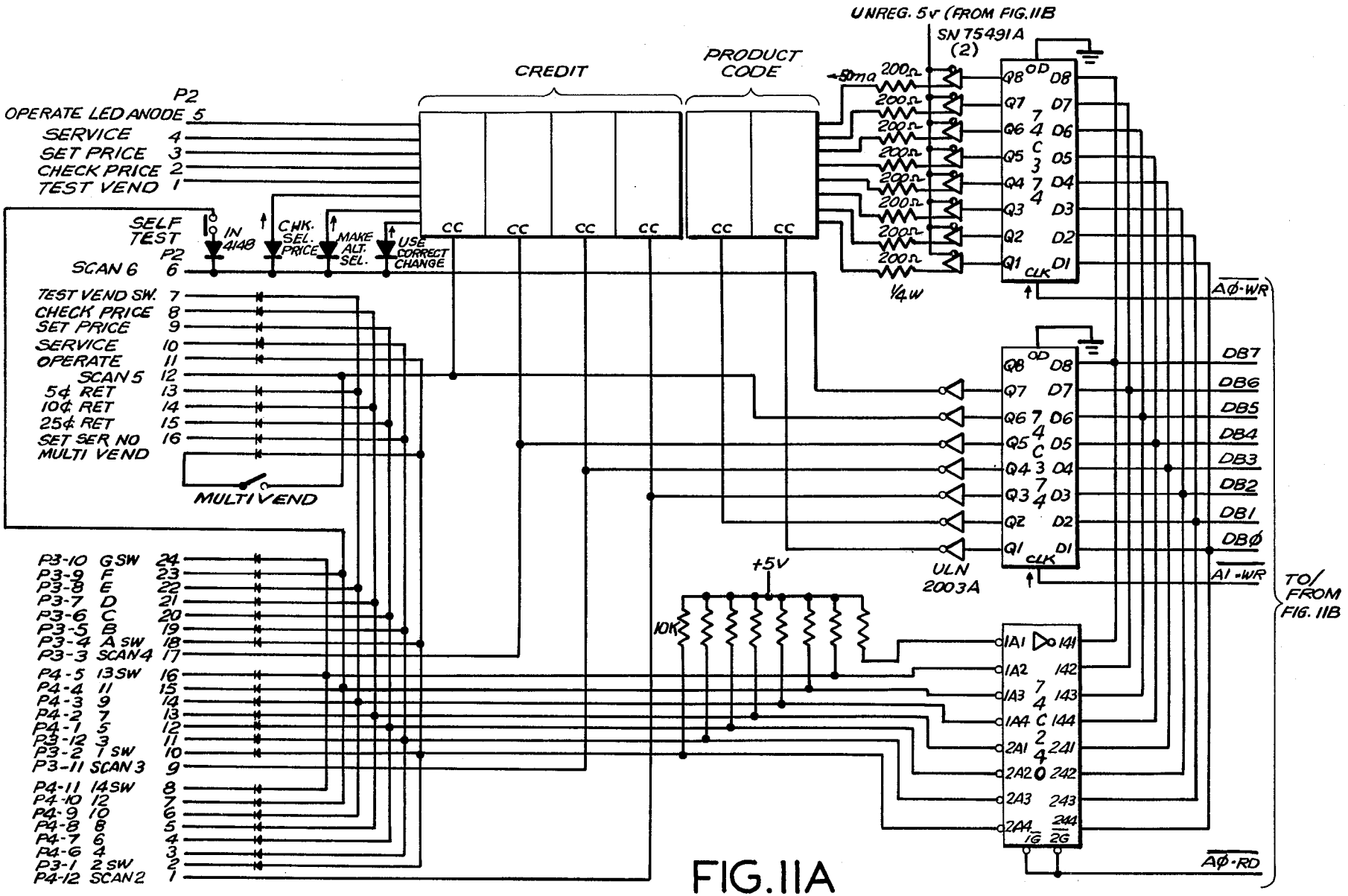
FIG. 11A through 11C is a schematic diagram of fifth embodiment of a control and diagnostic system of my invention.
Figure 11B:
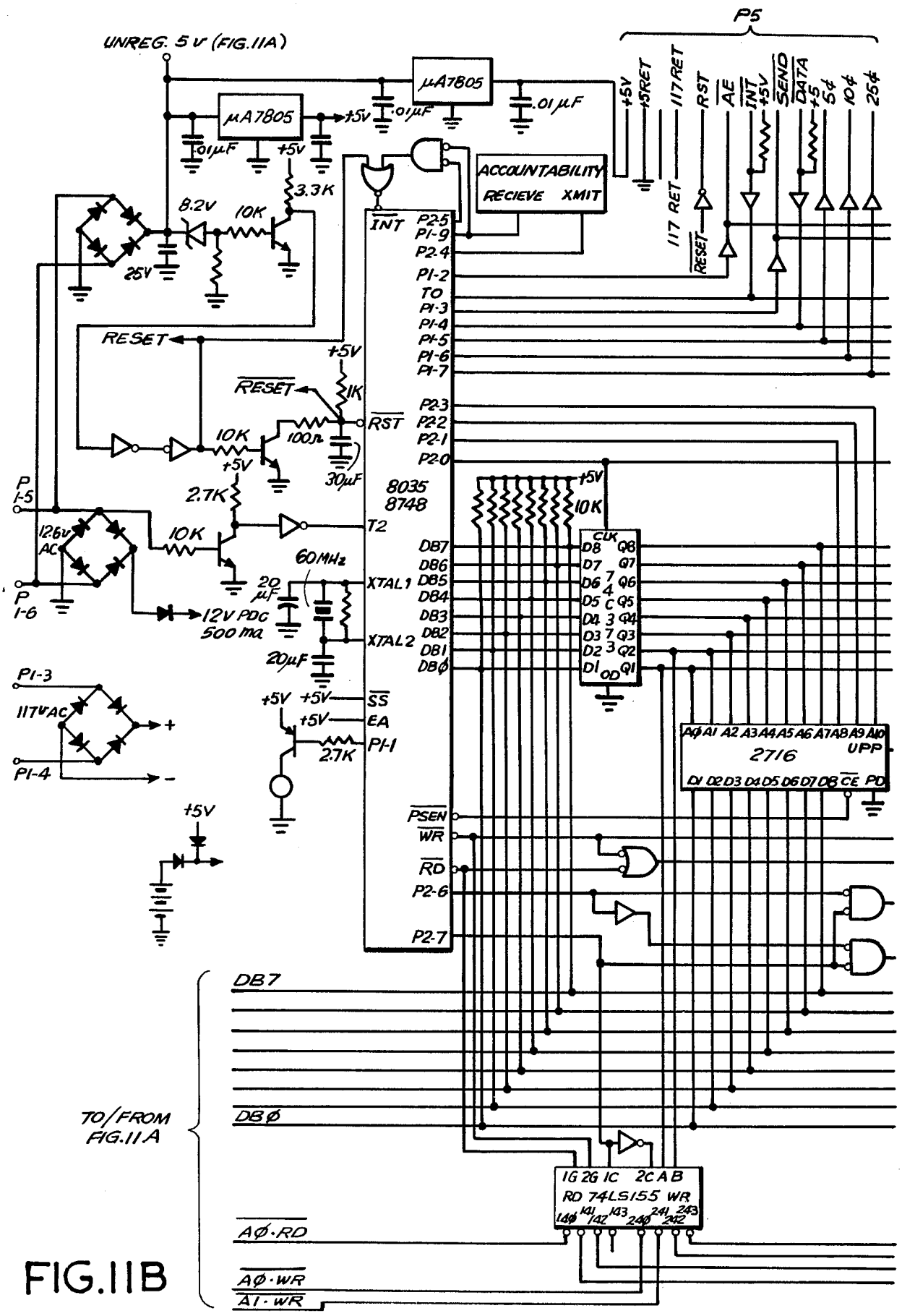
Figure 11B:
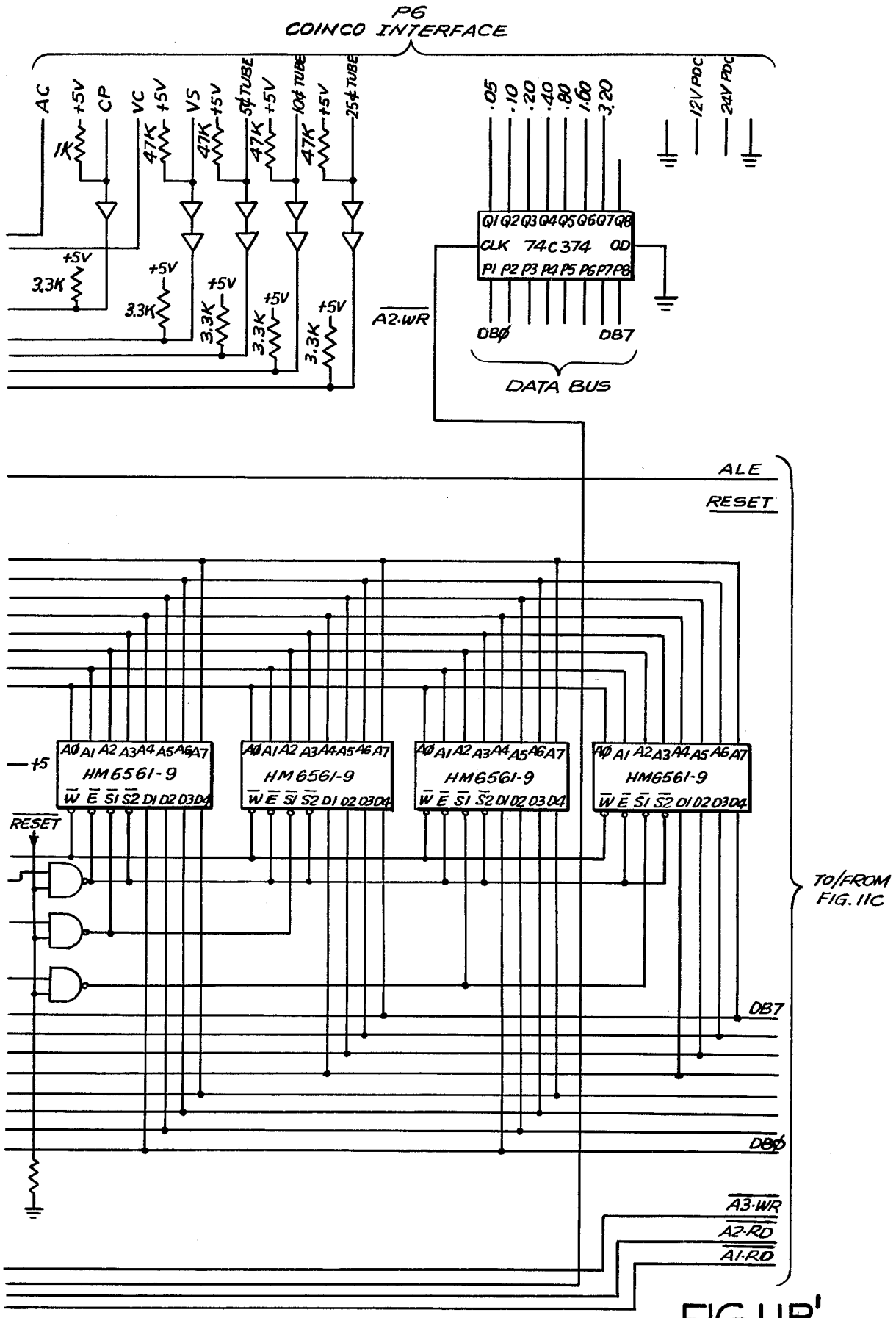
Figure 11C:
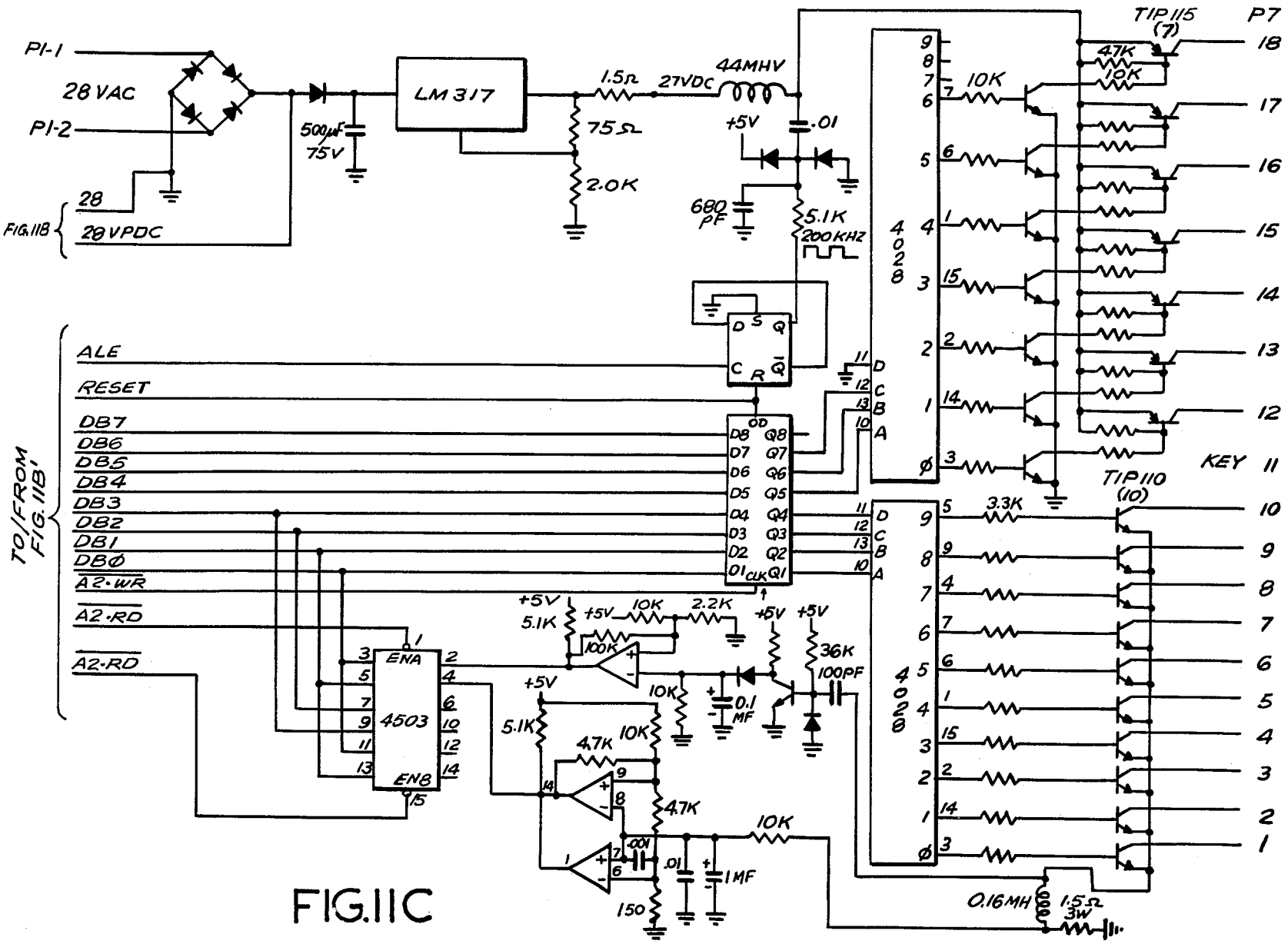

FIGS. 11A through 11C are a schematic diagram of a control and diagnostic system for a fifth embodiment of my invention the latest embodiment at the time my patent application was prepared. This embodiment, like the fourth embodiment, utilizes an AC test signal and is for use with vending apparatus with a actuator-switched capacitor parallel with each controlled actuator. Further details of the operation of this embodiment are disclosed in the computer program listing for the microprocessor 8035 submitted herewith.

I claim:

1. A vending machine apparatus comprising at least one product delevery means, said product delivery means comprising an electrically operated actuator for delivery of products, an impedance element and a circuit opening switch responsive to the position of the actuator, the impedance element and the switch being connected electrically in series with each other and in an electrically parallel circuit with the actuator, the opening and closing of the switch being controlled by the operation of the actuator; and means for detecting and providing a signal indicative of both changes in impedance of the parallel circuit occurring as a result of the opening and closing of the switch and changes occuring as a result of a change in impedance of the actuator.

2. The vending apparatus of claim 1 wherein the impedance element is a resistor and the resistance of each such resistor is of the same order of magnitude as that of the actuator it is in parallel with, but of a detectably different resistance from that of said actuator.

3. The vending apparatus of claim 2 further comprising means for applying to the parallel circuit a DC test current which is incapable of operating the actuator.

4. The vending apparatus of claim 3 further comprising a direct current power source wherein the actuator is operated by direct current from said power source.

5. The vending apparatus of claim 1 further comprising means to produce an AC test current and means for applying to the parallel circuit an AC test current which is incapable of operating the actuator, wherein the impedance element is a capacitor.

6. The vending apparatus of claim 5 wherein the means for detecting changes in impedance comprises filter means for separating test current from the current used to operate the actuator.

7. The vending apparatus of claim 5 further comprising a direct current power source wherein the actuator is operated by direct current from said power source.

8. The vending apparatus of claim 7 wherein the means for detecting changes in impedance comprises filter means for separating test current from the current used to operate the actuator.

9. The vending apparatus of claim 5 further comprising an alternating current power source providing alternating current of substantially different frequency from that of the test current, wherein the actuator is operated by alternating current from the alternating current power source.

10. The vending apparatus of claim 9 wherein the means for detecting changes in impedance comprises filter means for separating test current from the current used to operate the actuator.

11. The vending apparatus of any of claims 1 through 10 wherein the actuator output has a home position which is its normal start-stop position and the switch is open-circuited except when the actuator is in the home position.

12. The vending apparatus of any of claims 1 through 10 wherein the actuator output has a home position which is its normal start-stop position and the switch is short-circuited except when the actuator is in the home position.

13. The vending apparatus of any of claims 2 through 10 wherein a plurality of actuators are arranged in an electrical matrix with one electrical terminal of each actuator connected in common with each of the corresponding terminals of the actuators in the same row and another electrical terminal of each actuator connected in common with each of the corresponding terminals of the actuators in said column, and wherein the same means for detecting changes in impedance is employed with respect to the plurality of actuators.

14. The vending apparatus of claim 1 wherein a plurality of actuators each having a first and a second electrical power terminal are arranged in an electrical matrix with one electrical terminal of each actuator connected in common with each of the corresponding terminals of the actuators in the same electrical matrix row and another electrical terminal of each actuator connected in common with each of the corresponding terminals of the actuators in the same electrical matrix column, and wherein said means for detecting changes in the impedance is employed with respect to the plurality of actuators.

15. The vending apparatus of claim 14 wherein the actuator output of each of said actuators has a home position which is its normal start-stop position and switches responsive to the position of an associated actuator are open-circuited except when its associated actuator is in the home position.

16. The vending apparatus of claim 14 wherein the actuator output of each of the actuators has a home position which is its normal start-stop position and each of said switches is short-circuited except when the actuator is in the home position.

17. The vending apparatus of claim 14 wherein the actuators are physically arranged in a matrix of rows and columns corresponding to the electrical matrix.

18. The vending apparatus of claim 14 further comprising a diode in series with each actuator.

* * * * *

UNITED STATES PATENT AND TRADEMARK OFFICE

CERTIFICATE OF CORRECTION

PATENT NO. : 4,458,187

DATED : July 3, 1984

INVENTOR(S) : Frederic P. Heiman

It is certified that error appears in the above—identified patent and that said Letters Patent is hereby corrected as shown below:

Col. 10, line 67, after "810" insert --is--.

Signed and Sealed this

*Twelfth* Day of *March 1985*

[SEAL]

*Attest:*

DONALD J. QUIGG

*Attesting Officer* *Acting Commissioner of Patents and Trademarks*